US007422554B2

(12) United States Patent
Moscone et al.

(10) Patent No.: US 7,422,554 B2
(45) Date of Patent: Sep. 9, 2008

(54) CENTRIFUGE WITH AERODYNAMIC ROTOR AND BUCKET DESIGN

(75) Inventors: Kenneth J. Moscone, State College, PA (US); Craig Stout, Port Matilda, PA (US)

(73) Assignee: The Drucker Company, Inc., Philipsburg, PA (US)

( * ) Notice: Subject to any disclaimer, the term of this patent is extended or adjusted under 35 U.S.C. 154(b) by 158 days.

(21) Appl. No.: 11/500,708

(22) Filed: Aug. 8, 2006

(65) Prior Publication Data

US 2007/0037684 A1 Feb. 15, 2007

Related U.S. Application Data

(60) Provisional application No. 60/706,935, filed on Aug. 10, 2005.

(51) Int. Cl.
*B04B 5/02* (2006.01)

(52) U.S. Cl. ..... 494/20

(58) Field of Classification Search ..... 494/20, 494/21, 31, 33, 85; 422/72
See application file for complete search history.

(56) References Cited

U.S. PATENT DOCUMENTS 3,722,789 A * 3/1973 Kennedy ..... 494/20
4,391,597 A * 7/1983 Piramoon et al. ..... 494/20
4,435,169 A 3/1984 Romanauskas
4,585,434 A * 4/1986 Cole ..... 494/20
4,586,918 A * 5/1986 Cole ..... 494/20
4,589,864 A * 5/1986 Cole ..... 494/20
4,670,004 A 6/1987 Sharples et al.
4,718,885 A 1/1988 Potter
4,778,442 A 10/1988 Gordon
4,886,486 A * 12/1989 Grimm et al. ..... 494/20
4,941,867 A 7/1990 Tominaga
5,045,047 A * 9/1991 Hutchins et al. ..... 494/17
5,477,704 A 12/1995 Wright
5,562,582 A 10/1996 Malekmadani
5,562,584 A * 10/1996 Romanauskas ..... 494/20
6,811,531 B2 * 11/2004 Moscone, Sr. ..... 494/20
7,150,708 B2 * 12/2006 Lurz ..... 494/20
2006/0287182 A1 * 12/2006 Due et al. ..... 494/20
2007/0037684 A1 * 2/2007 Moscone et al. ..... 494/20

FOREIGN PATENT DOCUMENTS

EP 564834 A2 * 10/1993

* cited by examiner

*Primary Examiner*—Charles E Cooley
(74) *Attorney, Agent, or Firm*—McQuaide, Blasko, Fleming & Faulkner, Inc.

(57) ABSTRACT

A rotor and specimen holder assembly for producing a relatively low power, low audible level, cool running centrifuge. The centrifuge rotor assembly is designed to enable a specimen holder to retract into the body of the rotor during centrifugation to produce aerodynamic features.

8 Claims, 4 Drawing Sheets

CENTRIFUGE WITH AERODYNAMIC ROTOR AND BUCKET DESIGN

REFERENCE TO RELATED APPLICATIONS

This application claims priority to U.S. Provisional Patent Application No. 60/706,935 filed Aug. 10, 2005.

BACKGROUND OF THE INVENTION

1. Field of the Invention

The present invention relates to a centrifuge rotor and tube holder design, and more particularly, to a rotor assembly for producing a relatively low power, low audible level, cool running centrifuge.

2. Background Art

Centrifuges are commonly used in medical and biological research for separating and purifying materials of differing densities such as viruses, bacteria, cells, proteins, and other compositions. A centrifuge normally includes a motor, a rotor, and specimen holders capable of spinning up to tens of thousands of revolutions per minute. Specimen holders include, for example, test tubes, test tube holders, or any other means that is suitable for retaining a specimen.

A preparative centrifuge rotor has some means for accepting specimen holders or "buckets" containing the samples to be centrifuged. Preparative rotors are commonly classified according to the orientation of the sample tubes or buckets. Vertical tube rotors carry the sample tubes or buckets in a vertical orientation, parallel to the vertical rotor axis. Fixed-angle rotors carry the sample tubes or buckets at an angle inclined with respect to the rotor axis, with the bottoms of the sample tubes being inclined away from the rotor axis so that centrifugal force during centrifugation forces the sample toward the bottom of the sample tube or buckets. Swinging bucket rotors have pivoting tube carriers that are not horizontal when the rotor is stopped and that pivot the bottoms of the tubes outward under centrifugal force.

With current swinging bucket rotor designs, the centrifuge buckets are primarily left uncovered by the rotor and generate considerable aerodynamic drag. This drag increases as the non-aerodynamic features move further away from the axis of rotation. Although these aerodynamic features significantly impact upon rotor operations at speeds lower than 3,000 RPM, they can be an even more significant factor at higher RPMs. Because many newer laboratory and forensic protocols require much higher rotational speed during centrifugation, including up to, and well exceeding, 4,000 RPM, identifying efficient and cost effective means of reducing aerodynamic drag is desirable. With current rotor technology, the curved shape of the centrifuge buckets prevents the buckets from retracting into the rotor housing to completely seal the voids therein. Thus, significant aerodynamic drag is generated during centrifugation due to air entering the rotor through these voids.

Centrifugation generally involves rotating a sample solution at high speed about an axis to create a high centrifugal force to separate the sample into its components based upon their relative specific gravity. The sample is carried in a rotor which is placed in a centrifuge chamber in a centrifuge instrument. The rotor is driven to rotate at high speed by a motor beneath the centrifuge chamber. At high speed operations, aerodynamic drag on the rotor becomes increasingly significant. Significantly more power is required to overcome the aerodynamic drag at high speed. In addition, cooling means must be provided to offset the heat generated by aerodynamic friction. Some centrifuges are provided with means for drawing a vacuum or partial vacuum in the centrifuge chamber in an effort to reduce the aerodynamic drag; however, cooling can still be necessary.

In the past, cooling of the centrifuge chamber has been accomplished by attaching refrigerant coils to the outside of the centrifuge chamber (see, e.g., U.S. Pat. No. 5,477,704 to Wright). In such a configuration, a space must be provided between adjacent passages to allow for welding (e.g. at 19 and 20), which reduces the available surface area for efficient heat transfer from the chamber. Significant drawbacks of this design are that cooling or refrigerating the chamber is expensive and prone to malfunction. Accordingly, there is a need for a simple, cost effective means of reducing aerodynamic drag and resulting friction heat with certain swinging bucket rotor designs.

SUMMARY OF THE INVENTION

It is an object of the present invention to overcome the shortcomings of the prior art by providing a rotor and specimen holder assembly comprised of a centrifuge rotor assembly and a plurality of specimen holders. The rotor assembly is specifically designed to enable the specimen holders to retract into the body of the rotor during centrifugation to produce aerodynamic features. Slotted openings along the periphery of the rotor house the specimen holders. The specimen holders are designed to fill or plug these peripheral voids in the rotor as the rotor begins to rotate and the holders move into the retracted position.

Once the specimen holders are in the retracted position, the subjacent surface of each holder forms an uninterrupted interface about its slot which prevents circulating air from entering the rotor and tube holder assembly. This produces a continuous surface and an aerodynamic assembly that approaches the drag characteristics of a spinning disk. This interface also protects samples from the warmer circulating air and aids in keeping the samples at or near ambient temperatures. Voids near the center of the rotor may optionally be left open, as these locations' overall effect on drag is minimal.

The above and still further features and advantages of the present invention will become apparent upon consideration of the following detailed description of specific embodiments thereof, particularly when taken in conjunction with the accompanying drawings, wherein like reference numerals in the various figures are utilized to designate like components.

DETAILED DESCRIPTION OF THE INVENTION

Figure 1:
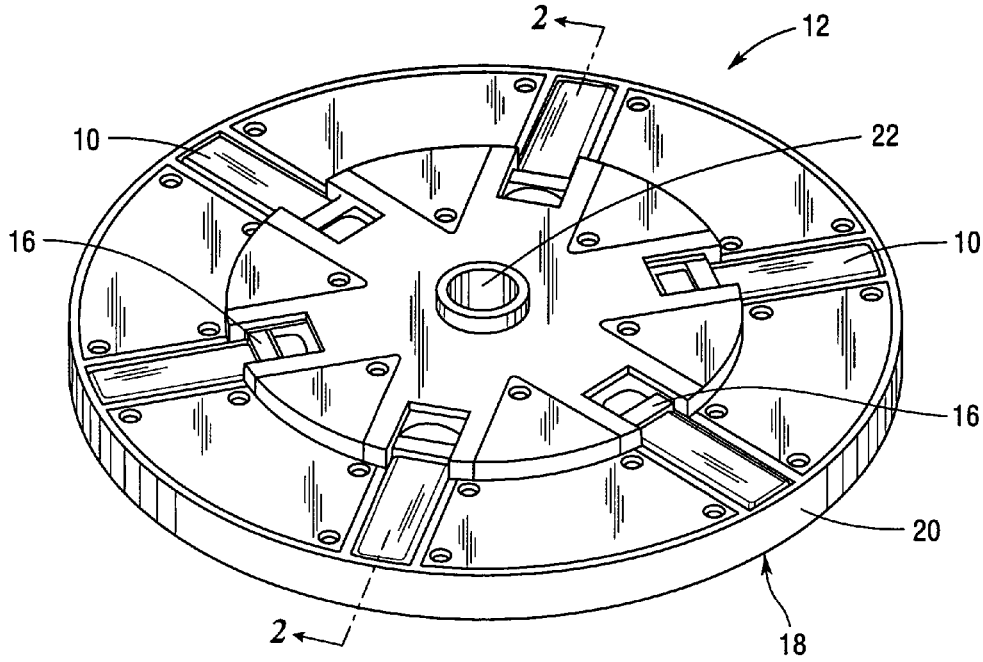
FIG. 1 is a bottom perspective view of a rotor and specimen holder assembly shown in the rotational position according to the present invention.

Referring now to FIGS. 1-8, the present invention comprises a novel design for a fully retractable specimen holder and rotor assembly for use in existing and new centrifuges 14 that are employed, for example, in medical, industrial, and laboratory settings.

The specimen holder 10 can either hold a specimen or some type of container, such as a test tube, test tube holder, or "bucket" containing a sample to be centrifuged. The rotor 12 and specimen holder assembly of the present invention may incorporate the use of specimen holders 10 having an extended collar 16, rotation pins, or other pivot mechanisms that enable the specimen holder 10 to swing from a resting position to a rotational position. Pivot mechanisms may include, for example, mounting holes, rivets, bolts, trunnions, springs, hinges, and the like.

The rotor 12 allows for the vertical or near vertical insertion of the specimen holder 10 and its contents. The extended collar 16, rotation pins, or other pivot mechanisms on the specimen holder prevent the specimen holder from falling through the rotor 12. In a preferred embodiment, the specimen holder 10 is primarily rectilinear in its cross-sectional geometry or includes at least one lower flat surface that forms a continuous, uninterrupted planar surface with the rotor bottom 18 to produce a more perfect aerodynamic feature. The present invention also enables the full retraction, inside the lower planar surface of the rotor, of round or multifaceted specimen holder configurations, significantly improving aerodynamic performance of the rotor assembly.

The rotor comprises a ribbed disc that supports and protects the specimen holders 10. The lower planar surface of the disc forms the rotor bottom 18 to which the ribs are attached. As an option, an outer rib 20 may extend about the outside circumference of the rotor bottom 18. The outer rib extends upward from the rotor bottom to form an exterior wall of the rotor 12 about the area containing the specimen holder. The outer rib 20 provides an aerodynamic shape to reduce air drag, protects the distal tip of the specimen holder 10, and provides radial support to the rotor 12. At the center of the rotor bottom 18 is a rotor hub 22 that extends upward from the rotor bottom. The rotor hub 22 has an open center to fit over a drive shaft of a centrifuge motor, which rotates the rotor. The rotor hub 22 acts as a bearing surface for the rotor 12.

Figure 3:
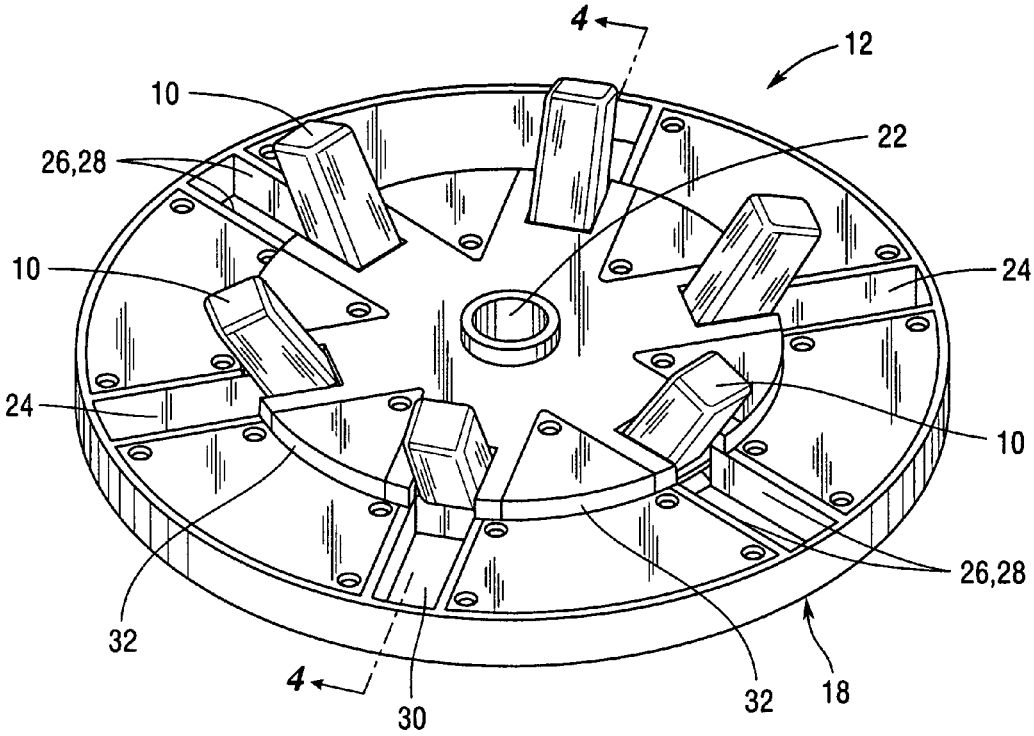
FIG. 3 is a bottom perspective view of a rotor and tube holder assembly shown at rest according to the present invention.
Figure 4:
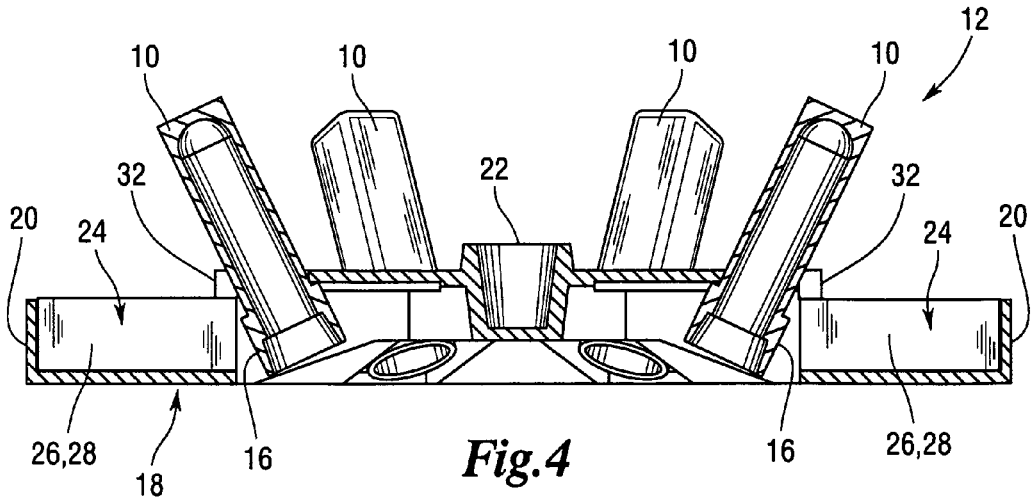
FIG. 4 is a cross-sectional view of a rotor and tube holder assembly shown at rest according to the present invention.

As shown in FIGS. 3 and 4, a series of elongated support channels 24 extend upward from the lower surface 18 of the rotor. The rotor 12 of the present invention may also employ fewer or more support channels 24, as appropriate for a particular application. Each channel 24 includes a pair of side ribs 26, 28 that support the specimen holder 10 and its contents during centrifugation. The bottom of the side rib 26 abuts the rotor bottom 18, and the top of the side rib 26 is parallel thereto. The interior or proximal section of the side rib 26 is positioned towards the rotor hub 22. The distal section of the side rib 26 extends towards the outer rib 20. The proximal section forms a ninety degree (90°) angle with, abuts against and supports the collar 16, rotation pins, and/or other pivot mechanisms of the specimen holder 10. The side ribs 26, 28 prevent movement of the specimen holder 10 beyond the horizontal position during rotation and also provide radial strength to the rotor 12.

In a preferred embodiment of the invention, the specimen holder 10 is ensconced within the support channel 24 so that, in the rotational position, no more than the outer tip (distant from the rotor hub 22) of the specimen holder extends beyond the distal edge of the side ribs 26, 28. In use, there is minimal to no protrusion of the specimen holder 10 into the centrifugal air stream about the rotor 12. In a preferred embodiment, the dimensions of the side ribs 26, 28 are commensurate to the proportions of the specimen holder 10 so that there is no protrusion of the specimen holder 10 beyond the support channel 24 (and into the centrifugal air stream).

Because the geometry and dimensions of the specimen holder 10 generally correspond to those of the support channel 24, the specimen holder 10 is able to nest or retract upward into, and horizontally align with, the support channel 24 during rotation of the rotor 12. Once the specimen holder 10 is in the retracted position, the subjacent surface of the holder is flush with the bottom 18 of the rotor so as to form a continuous planar surface. This uniform surface or interface 34 forms a barrier that severs access from the support channel 24 to a clearance slot 30 in the bottom surface 18 of the rotor. As a result, circulating air is prevented from entering the rotor and tube holder assembly, significantly decreasing aerodynamic drag on the rotor 12.

As depicted in FIGS. 1 and 4, each support channel 24 also includes a clearance slot 30 about the bottom 18 of the rotor to receive the specimen holder 10. Each clearance slot 30 has an interior end near the rotor hub 22. As shown, a side rib 26 extends upward from the rotor bottom 18 on each side of the clearance slot. The clearance slot 30, which may be predominantly square in its cross section geometry, allows the specimen holder 10 to swing from a generally vertical, resting position into a horizontal position during rotation of the rotor 12. During centrifugation, the specimen holder 10 remains recessed within the channel 24 and supported by the side ribs 26, 28. The clearance slot 30 is preferably wider than the main body of the specimen holder 10, but smaller than the diameter of the collar 16 of the specimen holder. Each side rib 26, 28 is shown flush with the clearance slot 30; however this arrangement is merely illustrative. The dimensions of the rotor 12, and clearance slot 30 may be configured to accommodate various specimen holder and pivot designs.

Figure 2:
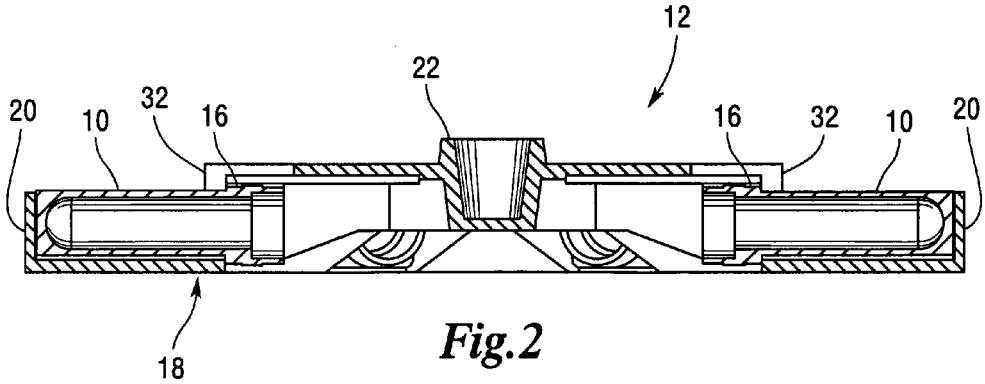
FIG. 2 is a cross-sectional view of a rotor and tube holder assembly shown in the rotational position according to the present invention.

As shown in FIGS. 1 and 2, the specimen holders 10 are designed to be contiguous with the clearance slots 30 as the rotor 12 begins to rotate and the holders move into the retracted position. Once the specimen holders 10 are in the retracted position within the body of the rotor 12, the lower or subjacent surface of each holder forms a substantially continuous and uninterrupted surface with the rotor bottom 18, which is preferably planar. As a result of this relative seal or interface 34 about the clearance slot 30, circulating air is prevented from entering the rotor and tube holder assembly. There is, therefore, no interruption in the flow of air (drag) about the rotor 12, and the specimen holder 10 itself is not subjected to the friction of air resistance during centrifugation. This produces an aerodynamic assembly that approaches the drag characteristics of a spinning disk. The continuous interface 34 also protects samples from the warmer circulating air and aids in keeping the samples at or near ambient temperatures. Voids near the center of the rotor 12 may optionally be left open, as these locations' overall effect on drag is minimal.

Extending from the side ribs 26, 28 of each channel 24 and towards the rotor hub 22 is an inner rib 32 that extends upward from the rotor bottom 18. The inner rib provides radial strength to the rotor 12. The distance between the inner ribs 32 on each side of the clearance slot 30 is preferably slightly wider than the width of the clearance slot, but smaller than the diameter of the extended collar 16 or other pivot mechanism of the specimen holder 10. A top surface of the inner ribs 32 is shown parallel to the rotor bottom 18 and intersects the proximal surface of the side ribs 26, 28 at a ninety degree (90°) angle.

Figure 5:
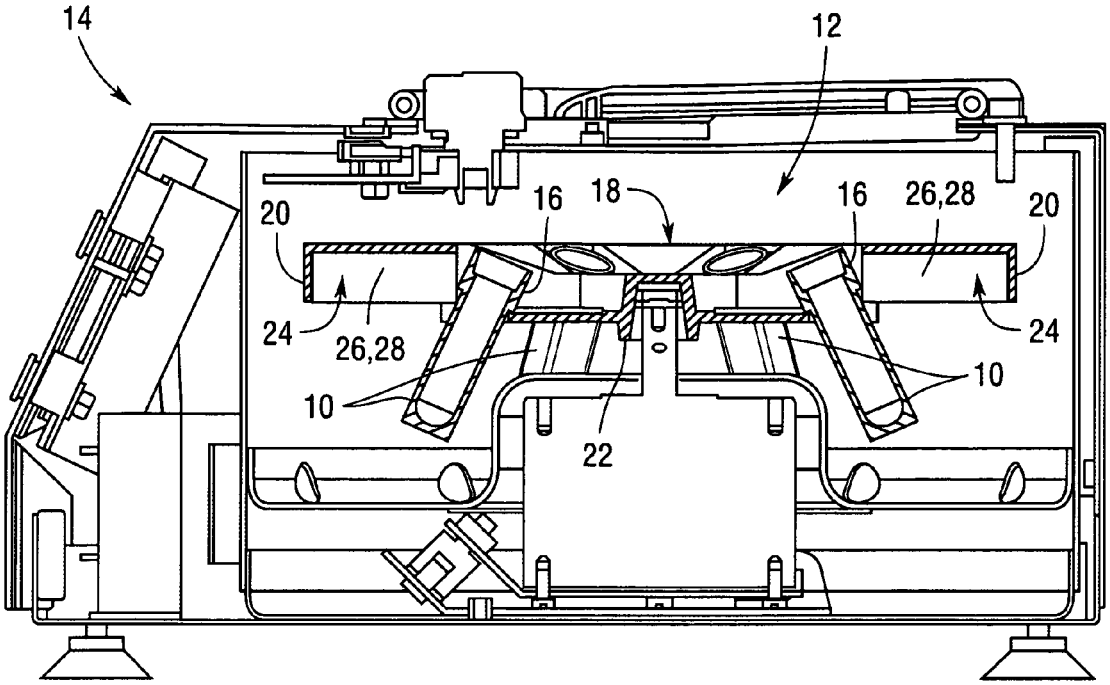
FIG. 5 is a cross-sectional view of a centrifuge assembly with the rotor shown at rest according to the present invention.
Figure 6:
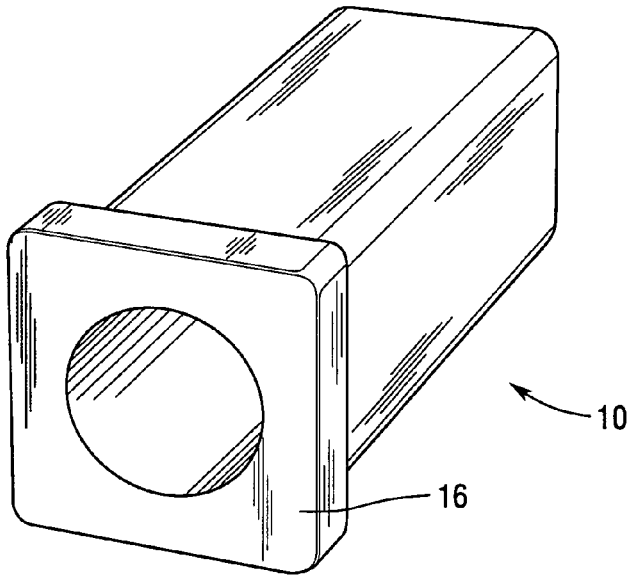
FIG. 6 is a perspective view of a specimen holder according to the present invention.
Figure 7:
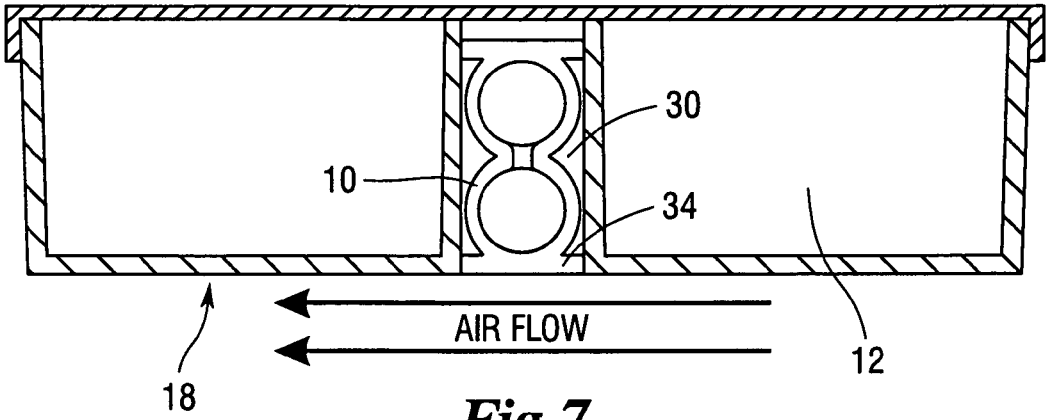
FIG. 7 is a cross-sectional view of a rotor featuring a specimen holder interface according to the present invention. Subsequent airflow about the rotor is also depicted.
Figure 8:
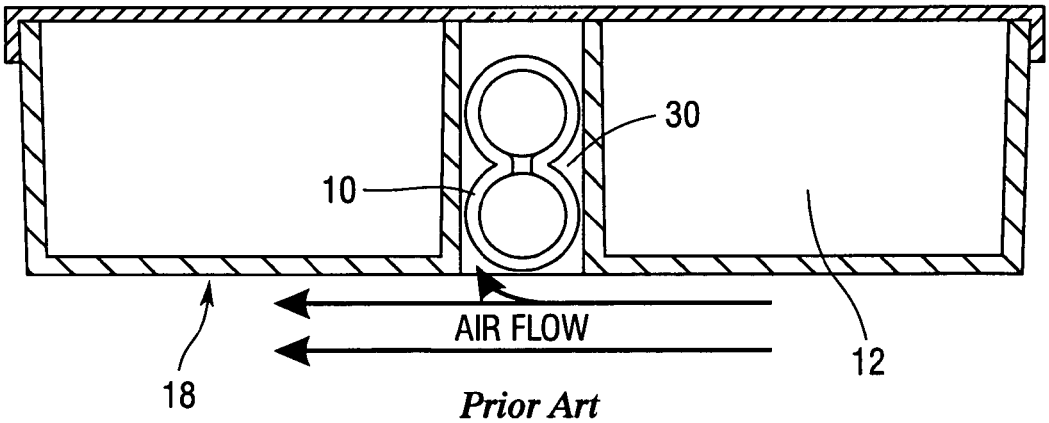
Prior Art Fig.8
FIG. 8 is a cross-sectional view of a rotor shown without a specimen holder interface. Circulating air flows into the rotor through openings positioned along the rotor periphery.

FIGS. 4-5 show the specimen holder 10 positioned in a near vertical position due to the design of the rotor 12. As shown, the distance between the proximal surface of the side rib 26 and the interior end of the clearance slot 30 is less than the diameter of the main body of the specimen holder. The specimen holder 10 pivot mechanism rests against the proximal surface of both side ribs 26, 28 and the top surface of the inner rib 32 on each side of the clearance slot 30.

In one embodiment of the invention, a flat cover (not shown) may be fitted over the top of the rotor 12 to protect the insides of the rotor. The cover can also be used to provide a more aerodynamic air flow over the rotor. The cover includes a center hole to allow insertion of one or more specimen holders 10 when the rotor is at rest.

The rotor 12 is utilized by being mounted to a drive system of the motor of the centrifuge 14. The specimen holder 10 can either hold a specimen or some type of container, such as a test tube or bucket containing a sample to be centrifuged. In a preferred embodiment, the specimen holder 10 is primarily square in its cross section geometry and/or includes at least one substantially planar or flat side. As such, the specimen holder 10 can be placed into a clearance slot 30 of the centrifuge 12 in any orientation. It will be appreciated that the geometry of the specimen holders 10 may be varied in accordance with the needs of a particular application or user preference. Similarly, any number and size of specimen holders 10 can be accommodated, dependent only on the size of the rotor 12.

When in place, the extended collar 16 or other pivot mechanism of the specimen holder rests against the inner ribs 32 associated with each clearance slot 30, whereby the collar supports the specimen holder 10 in a vertical or near vertical position in the rotor 12. The optional cover may already be in place during insertion of the specimen holder 10. Any additional components of the centrifuge 14 are properly positioned. The rotor 12 is rotated by the motor. The centrifugal force of rotation causes the specimen holder 10 to rotate upward from a rest or a near vertical position to a retracted position, as shown in FIGS. 1 and 2. When the specimen holder 10 is in the retracted position, the lower surface of the collar 16 of the specimen holder rests against the proximal surface of the side ribs 26, 28, and the support channel 24 protects the specimen holder within the rotor 12. While the specimen holder 10 is retracted within the rotor body during centrifugation, the inferior or subjacent surface of the specimen holder 10 is generally flush with the lower plane or bottom 18 of the centrifuge rotor.

As depicted in FIG. 2, during rotation of the rotor 12, the specimen holder 10 is retracts upward and nests within the support channel 24. In the retracted position, the specimen holder 10 is horizontally aligned with the support channel 24. Also, because the preferably planar subjacent surface of the holder is flush with the bottom surface 18 of the rotor, the holder surface and rotor bottom 18 comprise a single and uninterrupted interface. This continuous interface 34 traverses the clearance slot 30 in the bottom surface 18 of the rotor and serves as a barrier that severs access from the support channel 24 to the clearance slot 30. By substantially sealing the clearance slot 30 of the rotor 12, circulating air generated during rotation of the rotor 12 is prevented from entering the rotor body and tube holder assembly by way of the clearance slot 30. Moreover, the specimen holder 10 is not entirely subjected to the friction of air resistance during rotation and does not heat up due to the friction.

In the present invention, the specimen holder 10 fully, or at least substantially, occupies the support channel 24, and simultaneously overlays the clearance slot 30 such that there is generally no exposed area within the channel 24 and no protrusion of the specimen holder 10 into the centrifugal air stream about the rotor 12. As a result of this continuous interface 34, the clearance slot 30 is impervious to centrifugal air flow. Moreover, because there is no protrusion of the specimen holder 10 beyond the support channel 24 (and into the centrifugal air stream), the specimen holder contents are able to achieve a fully retracted position during rotation. This, in turn, allows for high-quality straight-line separation of fluids of varying densities, or fluids and suspended solids within the specimen holder 10.

When rotation of the rotor 12 is terminated, that is, when the centrifuge 14 stops spinning, the specimen holder 10 returns to its original, at rest position, due to gravity.

There are several advantages provided by the novel specimen holder design of the present invention. Because the specimen holder 10 will retract into a vertical position at relatively low RPM (less than 250 or 500 RPM), the specimen holder design impacts upon the aerodynamics of the rotor 12 operation even at relatively low RPM. At higher RPM, the design significantly impacts upon power consumption of the centrifuge 14, and substantially decreases the noise generated by aerodynamic drag. Moreover, the decrease in aerodynamic resistance results in less heat from friction.

Because the relationship between increased RPM and necessary horsepower is logarithmic, decreasing aerodynamic drag of the rotor 12 can have a considerable impact on the horsepower requirements for high speed operations. Moreover, since many modern centrifuges 14 use low temperature samples, this reduction in heat from friction is a tremendous benefit of the rotor specimen holder design of the present invention. Although the geometry of the specimen holder 10 (round, cylindrical, rectangular, etc.) may be varied in accordance with the needs of a particular application or user preference, it is preferable for the specimen holder 10 to be designed with at least one substantially planar surface, such as the design depicted in FIGS. 1 and 2. It is advantageous, in a preferred embodiment of the invention, that the cross section of the specimen holder be rectilinear and, preferably, square. The increased aerodynamic performance of the present rotor 12 and specimen holder 10 assembly decreases load on the centrifuge motor, and permits motors of smaller horsepower to be used to achieve a desired separation speed.

It will be appreciated that a representative use of the present invention involves the separation of platelets from plasma. Because this is more easily accomplished at RPMs in excess of 4,000, use of the present invention with the general rotor 12 design depicted in FIG. 5 allows the centrifuge 14 to achieve the required RPM with up to fifty percent (50%) less power than conventional means.

TABLE 1

Rotor/Specimen Holder Seal vs. Conventional Centrifuge Rotors

| SPECIFICATIONS | CONVENTIONAL ROTOR A | CONVENTIONAL ROTOR B | ROTOR/SPECIMEN HOLDER SEAL |
|---|---|---|---|
| Maximum RPM | 1700 | 2400 | 3300 |
| Time to Maximum RPM (sec) | 120 | 90 | 60 |
| Sample Degradation | 11 | 9 | 7 |

TABLE 1-continued

Rotor/Specimen Holder Seal vs. Conventional Centrifuge Rotors

| SPECIFICATIONS | CONVENTIONAL ROTOR A | CONVENTIONAL ROTOR B | ROTOR/SPECIMEN HOLDER SEAL |
|---|---|---|---|
| Above Ambient After 5 Minutes (F.) Sample Degradation | 26 | 17 | 9 |
| Above Ambient After 10 minutes (F.) Sample Degradation | 53 | 20 | 10 |
| Above Ambient After 60 minutes (F.) Sample Processing Time for Chemistries (min) | 15 | 12 | 7 |
| Sample Processing Time for Coagulation Studies (min) | 25 | 20 | 15 |
| Operating Power Consumption (Watts) | 231 | 120 | 92 |

Referring now to Table 1, there is shown a comparison of the improved operating speeds, sample quality and integrity, sample processing times, and power consumption of the rotor and specimen holder seal of the present invention versus conventional rotors. The data was collected at 115 VAC using a $1/30^{th}$ horsepower permanent split capacitor motor. Results were reproduced to ensure accuracy. Testing was conducted at QBC Diagnostics, Inc., State College, Pa. and at The Drucker Company, Inc., Philipsburg, Pa.

The foregoing data demonstrate that as compared to conventional centrifuge rotors, the specimen holder seal and rotor assembly of the present invention is able to: (a) reach desirable operating speeds in less time, (b) reach higher operating speeds without increasing power consumption, (c) reduce sample processing time, (d) improve sample quality due to the higher G forces, and (e) maintain sample integrity by minimizing the sample temperature rise above ambient.

While the invention has been particularly shown and described with reference to preferred embodiments thereof, it will be understood by those skilled in the art that various alterations in form and detail may be made therein without departing from the spirit and scope of the invention.

What is claimed is:

1. A rotor and specimen holder assembly for a centrifuge, comprising:

(a) a rotor body having a bottom surface;

(b) at least one slot about the bottom surface of said rotor for receiving a specimen holder;

(c) a specimen holder being retractable into the body of said rotor during rotation of the rotor; and (d) an interface traversing said slot for preventing air generated during rotation of the rotor from entering the rotor body, said interface comprising a substantially continuous surface formed by the rotor bottom and a subjacent surface of the specimen holder while said holder is in the retracted position.

2. The rotor and specimen holder assembly of claim 1 wherein the interface formed by the rotor bottom and said subjacent surface of the specimen holder is substantially planar.

3. The rotor and specimen holder assembly of claim 1 wherein the specimen holder comprises a rectilinear cross section.

4. The rotor and specimen holder assembly of claim 1 wherein the specimen holder comprises at least one horizontal surface.

5. The rotor and specimen holder assembly of claim 1 wherein the rotor bottom and the specimen holder form said subjacent continuous surface when the centrifuge is operated above about 250 RPM.

6. The rotor and specimen holder assembly of claim 1 wherein the rotor bottom and the specimen holder form said subjacent continuous surface when the centrifuge is operated above about 500 RPM.

7. A rotor and specimen holder assembly for a centrifuge, comprising:

(a) a rotor body having a bottom surface;

(b) at least one slot about the bottom surface of said rotor for receiving a specimen holder; and (c) a specimen holder being retractable into the body of said rotor during rotation of the rotor, wherein;

in the retracted position, a subjacent surface of said specimen holder is substantially continuous with said rotor bottom, surface, and said subjacent surface forms an interface about said slot, whereby circulating air is prevented from entering said rotor body and specimen holder assembly by way of said slot.

8. A rotor and specimen holder assembly for a centrifuge, comprising:

(a) a rotor body having a substantially planar bottom surface;

(b) at least one slot about the bottom surface of said rotor for receiving a specimen holder; and (c) a specimen holder being retractable into the body of said rotor during rotation of the rotor, said holder having at least one substantially planar surface, wherein;

in the retracted position, a subjacent surface of said specimen holder is continuous with said rotor bottom surface, and said subjacent surface forms an interface about said slot, whereby circulating air is prevented from entering said rotor body and specimen holder assembly by way of said slot.

* * * * *